US008177574B2

(12) United States Patent
Ju

(10) Patent No.: US 8,177,574 B2
(45) Date of Patent: May 15, 2012

(54) ELECTRICAL CONNECTOR CAPABLE OF PREVENTING SOLDER WICKING

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 54 days.

(21) Appl. No.: 12/879,560

(22) Filed: Sep. 10, 2010

(65) Prior Publication Data

US 2011/0189898 A1 Aug. 4, 2011

(30) Foreign Application Priority Data

Feb. 3, 2010 (CN) ..... 2010 2 0107750 U

(51) Int. Cl.
*H01R 4/50* (2006.01)
*H01R 13/625* (2006.01)

(52) U.S. Cl. ..... 439/342; 439/83

(58) Field of Classification Search ..... 439/342, 439/83, 856, 857, 884, 660
See application file for complete search history.

(56) References Cited

U.S. PATENT DOCUMENTS 6,766,817 B2 7/2004 da Silva
7,285,255 B2 10/2007 Kadlec et al.
7,377,904 B2 5/2008 Conway et al.
7,625,649 B1 12/2009 Faghri et al.
7,771,244 B1 * 8/2010 Ju ..... 439/857
7,819,822 B2 10/2010 Calasso et al.
7,828,562 B2 * 11/2010 Wu ..... 439/83
7,828,578 B1 * 11/2010 Ju ..... 439/342
8,016,623 B2 * 9/2011 Ju ..... 439/856
8,047,864 B1 * 11/2011 Ju et al. ..... 439/342
2007/0197937 A1 8/2007 Sarofim et al.
2008/0015531 A1 1/2008 Hird et al.

* cited by examiner

*Primary Examiner* — Hae Moon Hyeon
(74) *Attorney, Agent, or Firm* — Morris Manning & Martin LLP; Tim Tingkang Xia, Esq.

(57) ABSTRACT

The invention relates to an electrical connector capable of preventing solder wicking. The electrical connector has an insulating body that includes a plurality of containing grooves and conductives terminals installed in the containing grooves, a solder stop portion extended from a sidewall of the containing groove, the terminal having a main body portion between the solder stop portion and the sidewall, a contact portion extended upwardly from both ends of the main body portion and bent to both sides of the bump stopper and the solder stop portion separately, and a soldering portion extended downwardly from the main body portion and including a diffusion preventing area for separating the main body portion and the soldering portion, and the diffusion preventing area being higher than the lowest point of the solder stop portion.

25 Claims, 6 Drawing Sheets

ELECTRICAL CONNECTOR CAPABLE OF PREVENTING SOLDER WICKING

CROSS-REFERENCE TO RELATED PATENT APPLICATION

This non-provisional application claims benefits and priority under 35 U.S.C. §119(a) on Patent Application No. 201020107750.6 filed in The People's Republic of China on Feb. 3, 2010, which is incorporated herein by reference in its entirety.

Some references, if any, which may include patents, patent applications and various publications, are cited in a reference list and discussed in the description of this invention. The citation and/or discussion of such references is provided merely to clarify the description of the present invention and is not an admission that any such reference is "prior art" to the invention described herein. All references, if any, listed, cited and/or discussed in this specification are incorporated herein by reference in their entireties and to the same extent as if each reference was individually incorporated by reference.

BACKGROUND OF THE INVENTION

1. Field of the Invention

The present invention relates to an electrical connector, and more particularly to an electrical connector that is capable of preventing solder wicking.

2. Description of the Related Art

At present, common soldering technologies adopted by industries mainly include a surface mount technology and a pin-through-hole soldering technology, and solders are generally used in a soldering process regardless of which soldering technology is adopted. However, there are still existing problems such as solder wicking, missing solder, or false soldering.

A conventional electrical connector adopting the surface mount technology in general includes an insulating body having an upper surface and a lower surface opposite to each other, and a plurality of containing grooves penetrated through the upper surface and the lower surface, wherein each of the containing grooves has a bump stopper extended from a sidewall of the containing groove and disposed proximate to the lower surface, and a solder stop portion extended laterally downward from the bump stopper.

The conventional electrical connector further includes a plurality of conductive terminals contained in the containing grooves respectively, wherein each of the conductive terminals has a base disposed at the bottom of the bump stopper and between the solder stop portion and the sidewall. The lowest point of the base is higher than the lowest point of the solder stop portion. The base has a contact portion formed thereon and extended upwardly from both sides of the bump stopper. A containing space is formed between the two contact portions and provided for passing the bump stopper and the solder stop portion. At least one soldering portion is formed separately at both ends of the base and extended downwardly from both ends of the base. A solderable metal layer is brush-plated at the periphery of the soldering portion.

And moreover, the conventional electrical connector includes a plurality of solders contained in the containing groove and contacted with the solder stop portion, wherein a side of the solder is in contact with the solderable metal layer.

During the process of assembling such a conventional electrical connector, each conductive terminal is installed from the lower surface into the corresponding containing groove of the insulating body, such that the bump stopper and the solder stop portion are passed through the containing space. When the base is situated between the solder stop portion and the sidewall, the lowest point of the solder stop portion is lower than the base, and then each solder is placed into the corresponding containing groove.

When the electrical connector is soldered onto a printed circuit board, each solder is heated and melted into a liquid state by a high temperature. A portion of the electrical connector is attached onto the soldering portion of the conductive terminal, and another portion of the electrical connector is attached onto the printed circuit board, so that the electrical connector is soldered onto the printed circuit board to constitute an electric connection. Since the containing groove contains the solder stop portion, and the lowest point of the solder stop portion is lower than the base, therefore the solder in the liquid state can be prevented from climbing up towards the base, in other words, preventing the occurrence of a capillary phenomenon.

However, the conventional electrical connector has the following drawbacks:

1. When the soldering portion is soldered onto the printed circuit board, the solder is heated into a liquid state by a high temperature and attached onto the solderable metal layer. However, the solderable metal liquid may be diffused during the brush plating process, such that the solderable metal layer and the solder cannot be controlled within a specific range easily. Moreover, the conductive terminal is entered into the containing groove from the lower surface, thus the bump stopper and the solder stop portion have to come with a size and a width fitting the containing space between the two contact portions, so that the conductive terminal can be entered and fixed into the containing groove successfully. Meanwhile, the solder stop portion cannot cover both ends of the base which are the positions of the base coupled to the contact portions. As a result, solder wicking occurs, and the solder in the liquid state flows along the portion of the base which is not covered by the solder stop portion and towards the contact portion with capillary phenomenon.

2. When the solderable metal layer is brush-plated onto the soldering portion, the solderable metal layer may be brush-plated onto the base as well due to technical or operating problems, and thus increasing the production cost, causing a solder wicking phenomenon easily during the soldering process, and resulting in a poor soldering effect.

Therefore, a heretofore unaddressed need exists in the art to address the aforementioned deficiencies and inadequacies.

SUMMARY OF THE INVENTION

In one aspect, the present invention provides an electrical connector with a function for preventing a solder wicking phenomenon.

In one embodiment, an electrical connector of the present invention comprises: an insulating body, having at least one containing groove penetrated through the insulating body, a bump stopper extended from a sidewall of the containing groove, and a solder stop portion extended laterally downward from the bump stopper; at least one conductive terminal, installed in the containing groove, each conductive terminal having a main body portion disposed between the solder stop portion and the sidewall, a contact portion formed by extending and bending both ends of the main body portion upwardly and separately, the two contact portions being disposed between both sides of the bump stopper and the solder stop portion, at least one soldering portion extended downwardly from the main body portion and plated with a solderable metal layer, the soldering portion having a base layer, at least one diffusion preventing area concavely formed on the base layer and disposed above the solderable metal layer, and the diffusion preventing area being higher than the lowest point of the solder stop portion; and at least one solder, placed in the containing groove, abutted against the solder stop portion, and a side of the solder being in contact with the solderable metal layer.

In another embodiment, an electrical connector of the present invention comprises: an insulating body, having at least one containing groove penetrated through the insulating body, and a bump stopper extended from a sidewall of the containing groove; at least one conductive terminal, installed in the containing groove, each conductive terminal having a main body portion disposed between the solder stop portion and the sidewall, a contact portion formed by extending and bending both ends of the main body portion upwardly and separately, the two contact portions being disposed on both sides of the solder stop portion respectively, at least one soldering portion extended downwardly from the main body portion and plated with a solderable metal layer, the soldering portion having a base layer, at least one diffusion preventing area concavely formed on the base layer and disposed above the solderable metal layer, the diffusion preventing area being higher than the lowest point of the solder stop portion; at least one solder, placed at the containing groove and abutted against the solder stop portion, a side of the solder being in contact with the solderable metal layer.

Compared with the prior art, the electrical connector(s) of the present invention has the following advantages:

1. In the electrical connector of the present invention, the solder is soldered onto a printed circuit board, and after the solder is heated and melted into a liquid state by a high temperature, the solder is attached onto the solderable metal layer of the soldering portion. Since the conductive terminal includes the diffusion preventing area concavely formed by laser on the solderable metal layer and towards the base layer, and the diffusion preventing area is provided for separating the main body portion and the soldering portion, the solder wicking phenomenon can be prevented with the diffusion preventing area during the soldering process, even when there is a problem caused by the shape and structure of the conductive terminal and the solder stop portion that cannot cover both ends of the main body portion.

2. The laser manufacture provides a high precision, so that the area of the soldering portion can be controlled precisely to avoid unnecessary production costs incurred by coating the solderable metal layer onto the main body portion due to technical or operating problems, and also prevent the solder wicking phenomenon occurred during the soldering process.

These and other aspects of the present invention will become apparent from the following description of the preferred embodiment taken in conjunction with the following drawings and their captions, although variations and modifications therein may be affected without departing from the spirit and scope of the novel concepts of the disclosure.

BRIEF DESCRIPTION OF THE DRAWINGS

The drawings described below are for illustration purposes only. The drawings are not intended to limit the scope of the present teachings in any way.

DETAILED DESCRIPTION OF THE PREFERRED EMBODIMENTS

Figure 1:
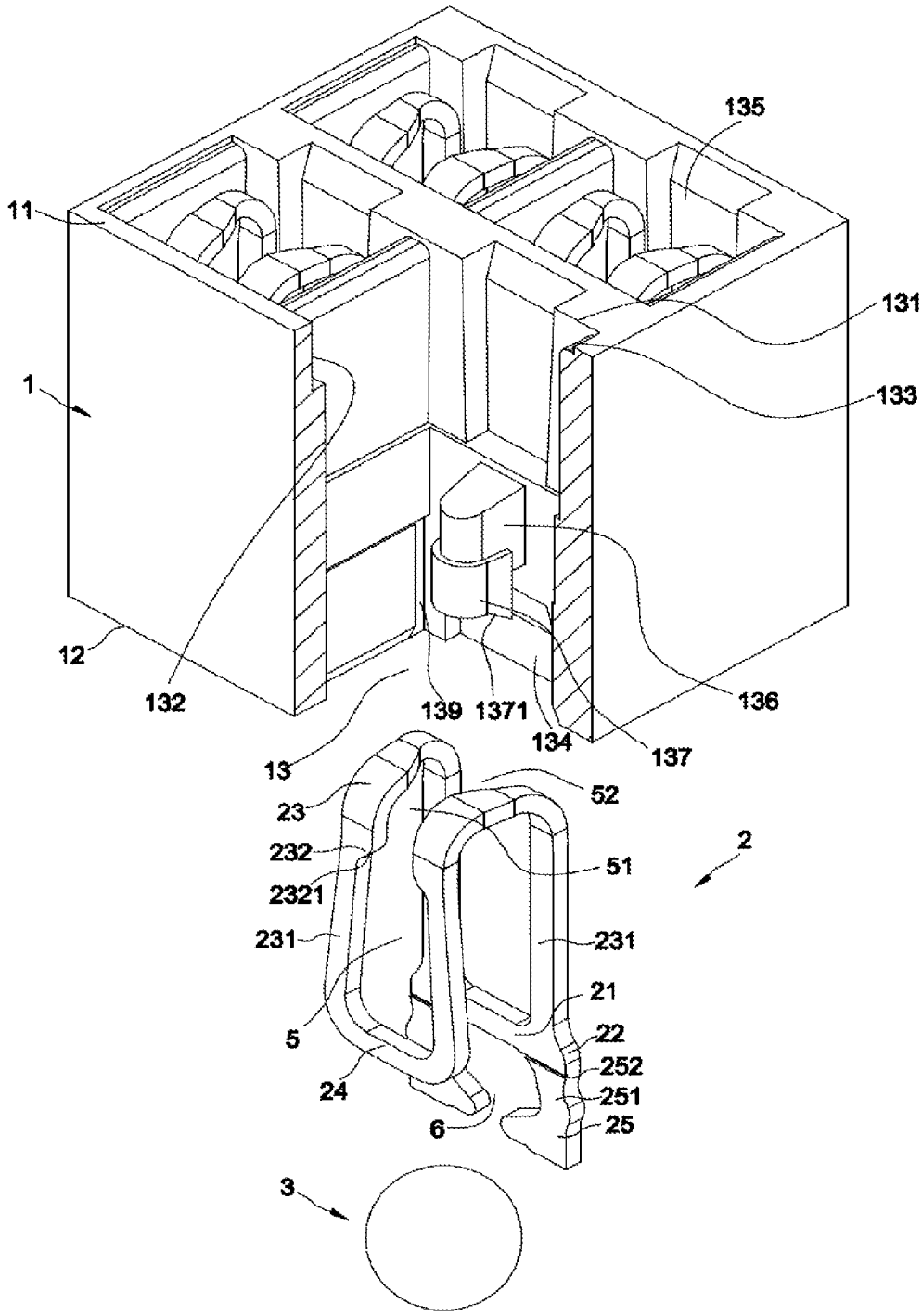
FIG. 1 is a partial exploded view of an electrical connector of the present invention.
Figure 2:
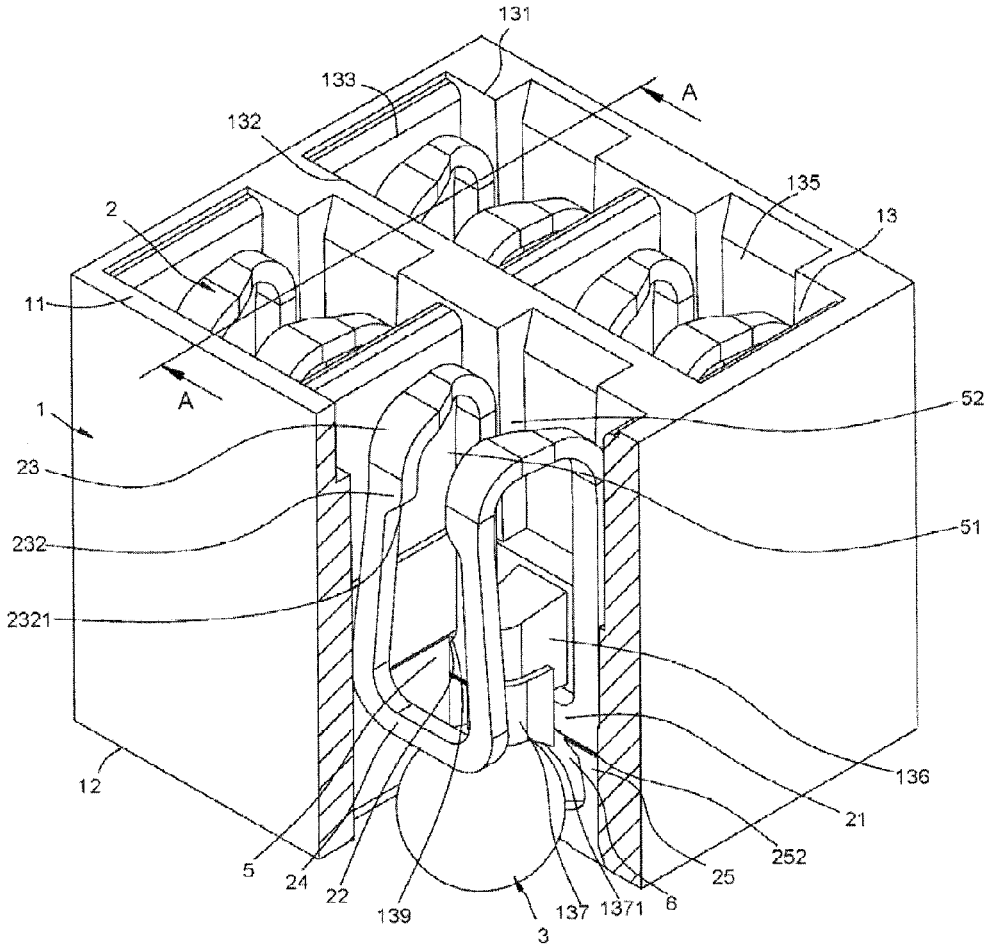
FIG. 2 is a perspective view of an electrical connector of the present invention.

The present invention is more particularly described in the following examples that are intended as illustrative only since numerous modifications and variations therein will be apparent to those skilled in the art. Various embodiments of the invention are now described in detail. Referring to the drawings, FIGS. 1-4, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention. Additionally, some terms used in this specification are more specifically defined below.

Definitions

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

Unless otherwise defined, all technical and scientific terms used herein have the same meaning as commonly understood by one of ordinary skill in the art to which this invention pertains. In the case of conflict, the present document, including definitions will control.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" means two or more.

As used herein, the terms "comprising," "including," "carrying," "having," "containing," "involving," and the like are to be understood to be open-ended, i.e., to mean including but not limited to.

It is noted that due to the shape and structure of the conductive terminal, the solder stop portion cannot cover both ends of the main body portion, and two contact portions are extended upwardly and respectively from both ends of the main body portion for electrically conducting a chip module. Under the premise of not changing the shape and structure of the conductive terminal, a diffusion preventing area is formed on the soldering portion of the conductive terminal by laser, such that the diffusion preventing area and the solder stop portion can overcome the solder wicking problem caused by the solder stop portion that fails to cover both ends of the main body portion.

More specifically, with reference to FIGS. 1 to 4, an electrical connector of the present invention according to various embodiments is provided for electrically connecting a chip module (not shown in the figures) to a printed circuit board (not shown in the figures), and the electrical connector comprises an insulating body 1, a plurality of conductive terminals 2 and a plurality of solders 3.

The insulating body 1 includes an upper surface 11 and a lower surface 12 opposite to each other, and a plurality of containing grooves 13 penetrated through the upper surface 11 and the lower surface 12, wherein the containing grooves 13 are arranged with an interval from one another.

Each of the containing grooves 13 has a first sidewall 131 and a second sidewall 132 disposed opposite to each other, and two third sidewalls 133 connected to the first sidewall 131 and the second sidewall 132 respectively. The first sidewall 131 includes a gap 134 concavely formed at a position proximate to the lower surface 12, penetrated through the lower surface 12, and interconnected to the containing groove 13, a giving-way space 135 concavely formed at a position proximate to the upper surface 11 for providing a space to enter pins of the chip module (not shown in the figure) into the containing groove 13, a bump stopper 136 extended from a position of the first sidewall 131 between the gap 134 and the giving-way space 135, and a solder stop portion 137 extended laterally downward from an end of the bump stopper 136 and not connected to the first sidewall 131. The solder stop portion 137 includes a contact surface 1371 facing the second sidewall 132, and the contact surface 1371 is in an arc shape. Of course, in another embodiment, the solder stop portion 137 can be formed and extended laterally downward from the middle of the bump stopper 136, and the bump stopper 136 can be connected to the second sidewall 132, and the contact surface 1371 can be in another shape.

The second sidewall 132 includes a containing space 138 concavely formed thereon and interconnected to the containing groove 13, and the containing space 138 and the giving-way space 135 are arranged opposite to each other.

Each of the two third sidewalls 133 includes a latch slot 139 formed at a position proximate to the first sidewall 131, penetrated through the lower surface 12, and disposed separately on both sides of the gap 134.

Each conductive terminal 2 is installed in the corresponding containing groove 13 and includes a main body portion 21 fixed into the containing groove 13.

The main body portion 21 includes a fixing portion 22 formed separately on both sides of the main body portion 21 and latched into the latch slot 139 for fixing the conductive terminal 2 into the containing groove 13.

The main body portion 21 is disposed at the bottom of the bump stopper 136 and between the solder stop portion 137 and the first sidewall 131. An interval 4 is formed between the main body portion 21 and the solder stop portion 137 to facilitate entering the conductive terminal 2 into the containing groove 13 (or in other embodiments, the main body portion 21 is contacted with the solder stop portion 137).

The main body portion 21 includes a contact portion 23 formed and extended upwardly and separately above both ends of the bump stopper 136, and the contact portion 23 is provided for electrically coupling pins of the chip module (not shown in the figure). Free ends of the two contact portions 23 are connected to each other to reinforce the effect of clamping the pins of the chip module (not shown in the figure) by the two contact portions 23, and an abutting portion 24 is formed at the position where the two free ends are connected, and the abutting portion 24 abuts against the second sidewall 132. The two contact portions 23 are disposed on both sides of the bump stopper 136 and the solder stop portion 137, and the two contact portions 23 include two arm portions 231. A protrusion 232 is extended inwardly from the internal sides of the two arm portions 231, and the protrusion 232 includes a contact end 2321 in contact with the pins of the chip module (not shown in the figure). A narrow groove 5 is formed between the two arm portions 231 and interconnected to the containing space 138. The narrow groove 5 includes a clamping slot 51 and a guiding space 52, wherein the guiding space 52 has a width greater than the clamping slot 51. The pins of the chip module (not shown in the figure) are entered into the giving-way space 135, and then the guiding space 52 is provided for guiding the clamping slot 51 to reach the containing space 138 and contacted with the contact end 2321 of the protrusion 232 to constitute an electric connection.

A soldering portion 25 is formed and extended downwardly and separately from both ends of the main body portion 21 and provided to be soldered onto the printed circuit board (not shown in the figure). The soldering portion 25 is disposed on a side of the gap 134 of the first sidewall 131, and free ends of the two soldering portions 25 are not connected to each other, and an accommodating space 6 is formed between the two free ends.

The cross-section of the soldering portion 25 is a multilayer structure including a base layer (not shown in the figure) and a solderable metal layer 251 covered onto the exterior of the base layer (not shown in the figure). The base layer (not shown in the figure) includes an inner layer (not shown in the figure) and a non-solderable metal layer (not shown in the figure) plated onto the exterior of the inner layer (not shown in the figure), wherein the solderable metal layer 251 is plated onto the exterior of the non-solderable metal layer (not shown in the figure). A diffusion preventing area 252 is formed from the solderable metal layer 251 towards the base layer (not shown in the figure) by laser (or in another preferred embodiment, the soldering portion 25 includes the diffusion preventing area 252 formed separately on both sides of the soldering portion 25 by laser), and the diffusion preventing area 252 is concavely disposed into the non-solderable metal layer (not shown in the figure) (or in another embodiment, the diffusion preventing area 252 is concavely disposed into the inner layer). The diffusion preventing area 252 is higher than the solder stop portion 137. The diffusion preventing area 252 is an area provided for separating and defining the soldering portion 25 and the main body portion 21 (or in another embodiment, the lowest point of the solder stop portion 137 is disposed at the position where the diffusion preventing area 252 and the solder 3 are contacted with the soldering portion 25), and its surface is a rough surface.

In this preferred embodiment, the conductive terminal 2 is bent into an arch shape, and of course it can be of another shape. Both sides of the conductive terminal 2 have different lengths, and an end of the main body portion 21 is lower than an end of the abutting portion 24 to facilitate electroplating a side of the soldering portion 25 extended from the main body portion 21.

Each solder 3 is placed into the containing groove 13 and abutted and contacted with the contact surface 1371 of the solder stop portion 137. One side of the solder 3 is contacted with the solderable metal layer 251, and the solder 3 is partially entered into the accommodating space 6.

During the assembling process, each conductive terminal 2 is installed from the lower surface 12 into one of the containing grooves 13 of the insulating body 1. The two arm portions 231 of the contact portion 23 are disposed on both sides of the bump stopper 136 and the solder stop portion 137 respectively, and inserted along the conductive terminal 2 accordingly. The bump stopper 136 and the solder stop portion 137 reach deeply into the narrow groove 5 until the fixing portion 22 is latched into and stopped at the latch slot 139. Now, the bump stopper 136 is situated above the main body portion 21 and a crevice is formed between the bump stopper 136 and the main body portion 21 to prevent the conductive terminal 2 from being inserted into the containing groove 13 by an excessively large force and prevent the bump stopper 136 from being collided or damaged. The interval 4 between the main body portion 21 and the solder stop portion 137 is maintained to facilitate the conductive terminal 2 to be entered into the containing groove 13. The diffusion preventing area 252 on the soldering portion 25 opposite to the main body portion 21 is higher than the lowest point of the solder stop portion 137.

Each solder 3 is placed into the containing groove 13 of the insulating body 1 from the lower surface 12, until the top of the solder 3 is in contact with the contact surface 1371. The contact surface 1371 has a shape corresponding to the solder 3 to prevent damaging the solder 3, and a side of the solder 3 is in contact with the solderable metal layer 251.

When the solderable metal layer 251 is brush-plated onto the soldering portion 25, the conductive terminal 2 includes the diffusion preventing area 252 concavely formed on the solderable metal layer 251 and towards the base layer (not shown in the figure) by a laser technology. Since the laser technology can achieve a high-precision manufacture, therefore the soldering area of the soldering portion 25 can be controlled precisely, and the soldering position can be very accurate. As a result, the production cost can be reduced, and the occurrence of the solder wicking phenomenon can be prevented.

When the electrical connector of the present invention is soldered onto the printed circuit board (not shown in the figure), the solder 3 is heated and molten into a liquid state by a high temperature, and then the solder 3 is attached onto the solderable metal layer 251 of the soldering portion 25. The first sidewall 131 on a side of the soldering portion 25 has the gap 134 formed thereon, such that a portion of the solder 3 in the liquid state can be entered into the gap 134 to increase the area of the soldering portion 25 for attaching the solder 3, so as to reinforce the secured attachment between the solder 3 and the soldering portion 25. Another portion of the solder 3 is attached onto the printed circuit board (not shown in the figure) to complete soldering the electrical connector and the printed circuit board (not shown in the figure) to constitute an electric connection.

In the soldering process, the conductive terminal 2 is entered into the containing groove 13 from the lower surface 12, and the bump stopper 136 and the solder stop portion 137 must have a width and a size that fit the narrow groove 5 between the two arm portions 231 before they can be entered and fixed into the containing groove 13 successfully. As a result, the solder stop portion 137 fails to cover both ends of the main body portion 21 which are positions where the contact portion 23 is coupled to the main body portion 21. The diffusion preventing area 252 is formed separately on the two soldering portions 25 below both ends of the main body portion 21 by laser to compensate the drawbacks caused by the shape and structure of the conductive terminal 2, so as to prevent the solder 3 in the liquid state from having a solder wicking phenomenon (which produces a capillary phenomenon) along the positions of the main body portion 21 that are not covered by the solder stop portion 137 and towards the contact portion 23.

Figure 5:
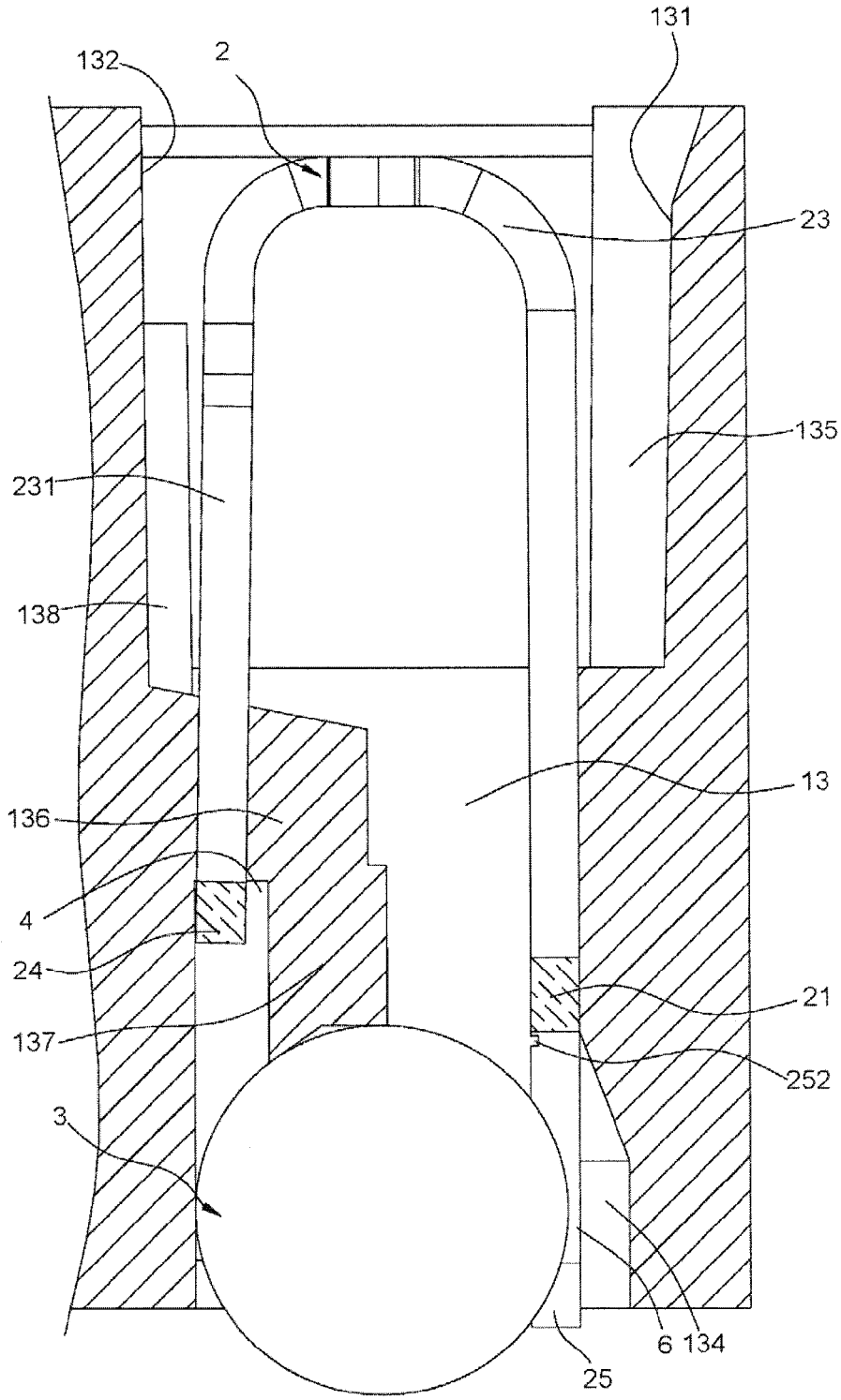
FIG. 5 is a cross-sectional view of a second embodiment of the present invention.

In another preferred embodiment of the electrical connector of the present invention as shown in FIG. 5, the solder stop portion 137 is coupled to the second sidewall 132 through the bump stopper 136 (or the solder stop portion 137 can be formed and extended laterally downward from the middle of the bump stopper 136). The bump stopper 136 can be connected to the second sidewall 132, and the bump stopper 136 is disposed above the abutting portion 24 (or the bump stopper 136 and the abutting portion 24 can be abutted with each other). A crevice is formed between a lateral side of the abutting portion 24 and the solder stop portion 137 (or a lateral side of the abutting portion 24 can be contacted with the solder stop portion 137), and the main body portion 21 of the conductive terminal 2 is disposed between the solder stop portion 137 and the first sidewall 131. The effects achieved by the preferred embodiments can be accomplished by this preferred embodiment as well, and thus they will not be described here again.

Figure 3:
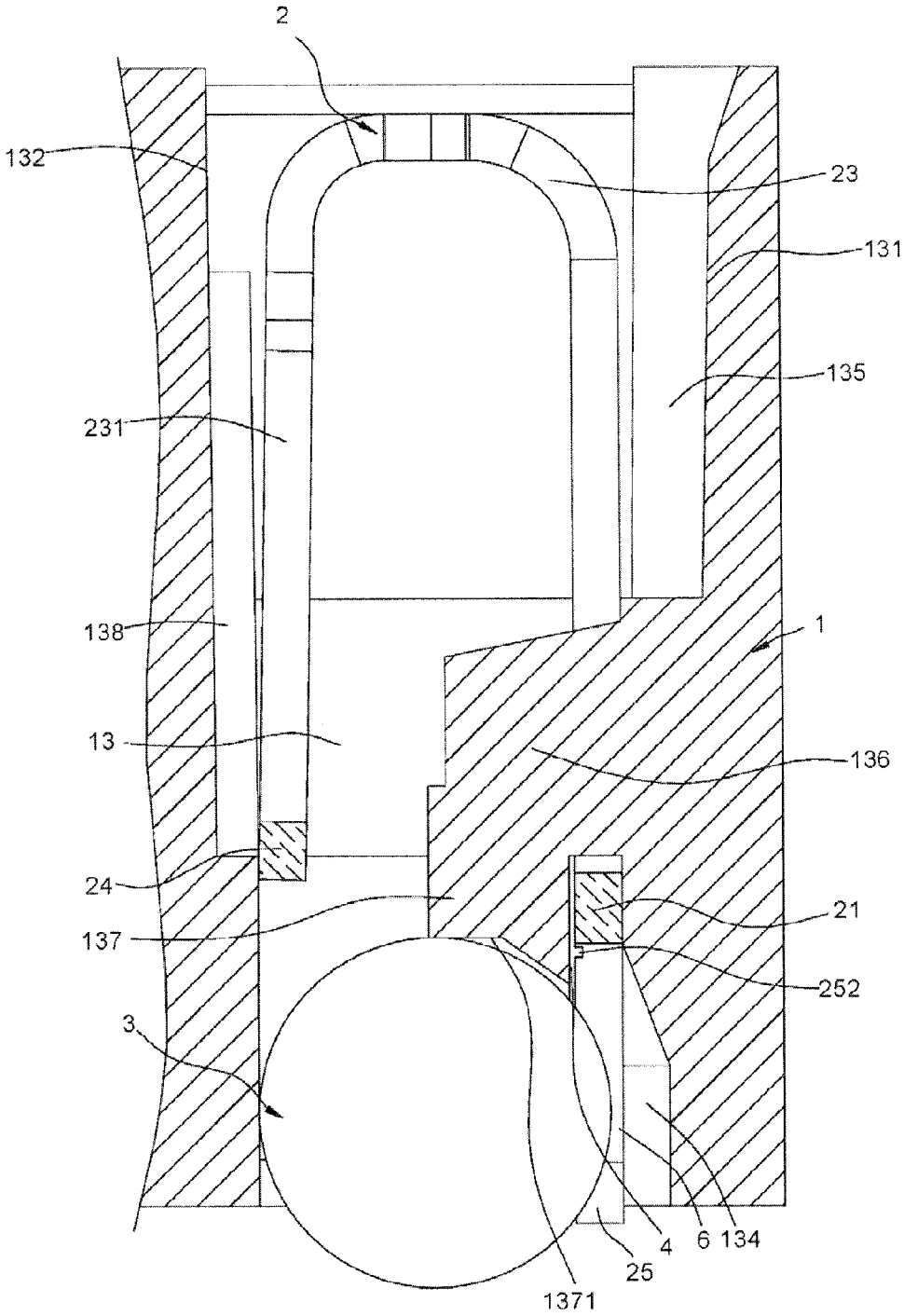
FIG. 3 is a cross-sectional view of Section A-A of the electrical connector of FIG. 2.
Figure 4:
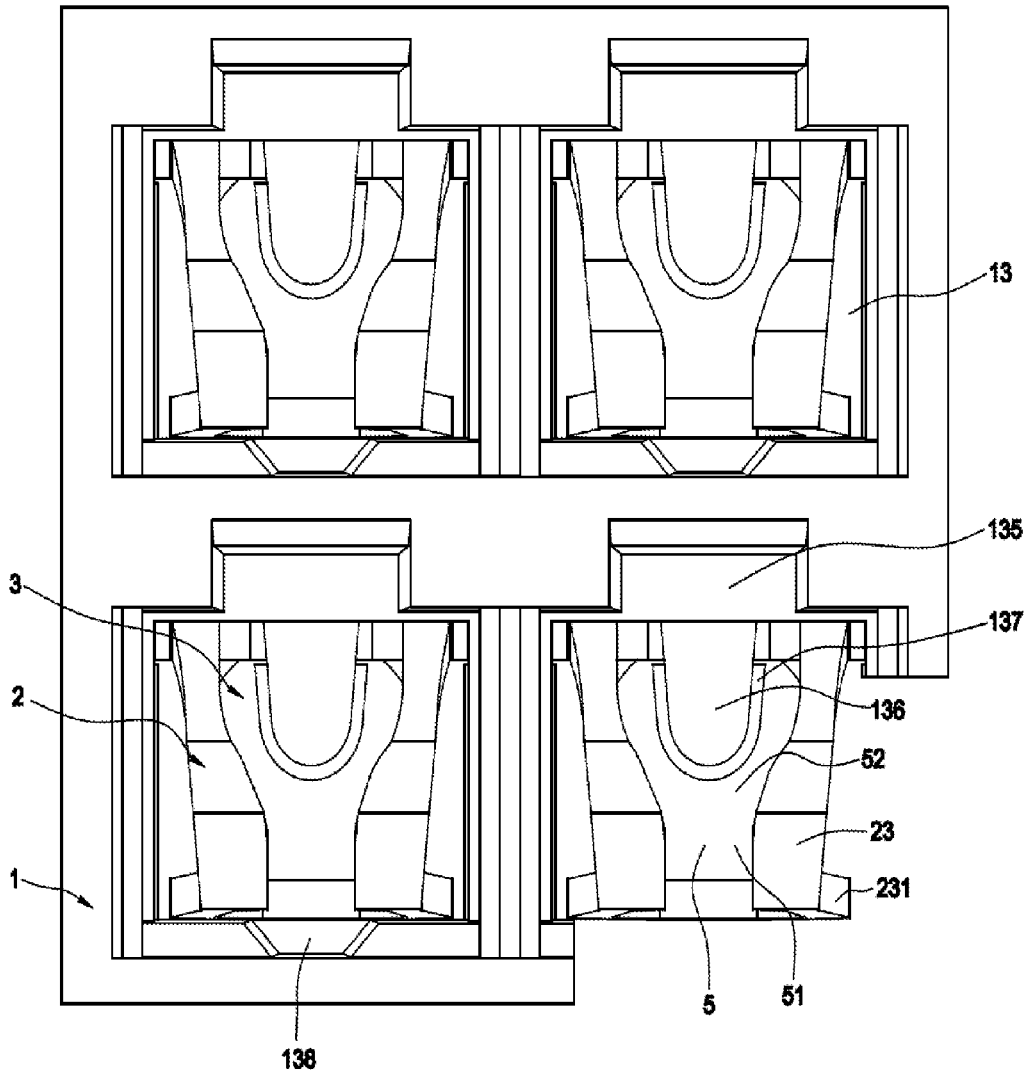
FIG. 4 is a top view of the electrical connector of FIG. 2.
Figure 6:
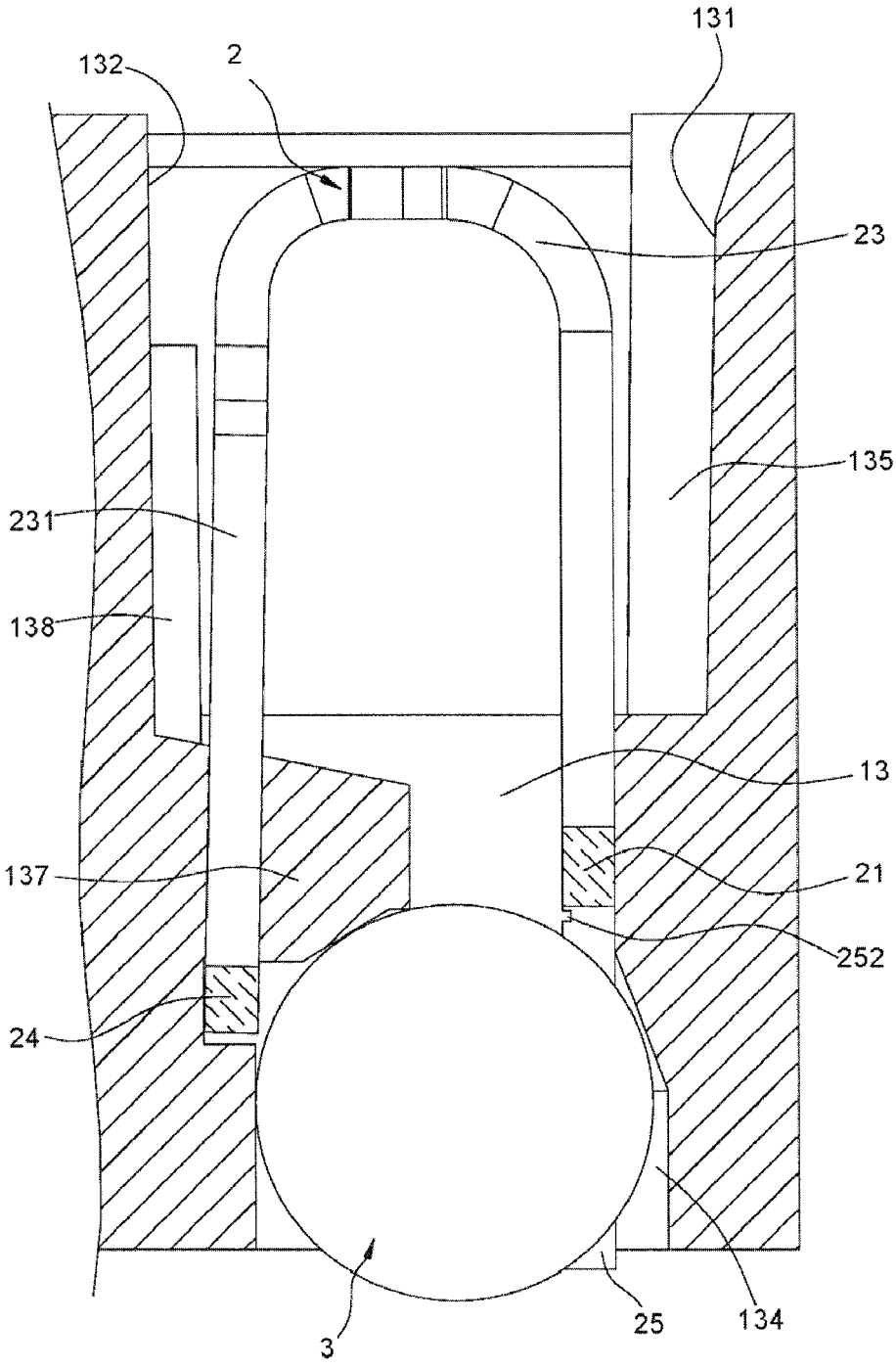
FIG. 6 is a cross-sectional view of a third embodiment of the present invention.

In a further preferred embodiment of the electrical connector of the present invention as shown in FIG. 6, the difference of this preferred embodiment and the aforementioned preferred embodiments resides on that this preferred embodiment does not have the bump stopper 136 as shown in FIG. 3, but the solder stop portion 137 is formed and extended from the second sidewall 132, and the solder stop portion 137 is disposed above the abutting portion 24, such that the two arm portions 231 formed on the abutting portion 24 can be extended appropriately, and the height and the direction of the solder stop portion 137 on the main body portion 21 allow the solder stop portion 137 to cover the main body portion 21. In addition to the solderable metal layer 251 plated onto the soldering portion 25, other portions of the conductive terminal 2 are plated with the non-solderable metal layer (not shown in the figure), so that the length of the arm portion 231 can be extended without touching the solder 3, to avoid the solder 3 being attached onto the abutting portion 24 when heated into a liquid state by a high temperature. The effects achieved by the foregoing preferred embodiments can be accomplished by this preferred embodiment as well, and thus they will not be described here again.

In summation of the description above, the electrical connector(s) of the present invention has at least the following advantages over the conventional electrical connector:

1. When the solderable metal layer is brush-plated onto the soldering portion, the conductive terminal includes the diffusion preventing area concavely formed on the solderable metal layer and towards the base layer (not shown in the figure) by a laser technology. Since the laser technology can achieve a high precision manufacture, the soldering area of the soldering portion can be controlled precisely, and the soldering position can be very accurate. As a result, the production cost can be saved, and the occurrence of the solder wicking phenomenon can be avoided.

2. In the soldering process, the conductive terminal is entered into the containing groove from the lower surface, and the bump stopper and the solder stop portion must have a width and a size that fit the narrow groove between the two arm portions before they can be entered and fixed into the containing groove successful. In other words, the solder stop portion cannot cover both ends of the main body portion which is the positions where the contact portion is coupled to the main body portion. Since the diffusion preventing area is formed separately on the two soldering portions below both ends of the main body portion by laser to compensate the drawbacks caused by the shape and structure of the conductive terminal, so as to prevent the solder in the liquid state from having the solder wicking phenomenon (or producing a capillary phenomenon) along the positions of the solder stop portion not covering the main body portion and towards the contact portion.

3. The solder stop portion has the contact surface in an arc shape to match the shape of the solder to prevent the solder from being damaged when placed into the containing groove by an excessively large force.

4. When the electrical connector of the present invention is soldered onto the printed circuit board, the solder is heated and molten into a liquid state by a high temperature, a portion of the solder is attached onto the solderable metal layer of the soldering portion The gap formed on the first sidewall on a side of the soldering portion is provided for allowing the solder in the liquid state to enter into the gap to increase the area of the soldering portion for attaching the solder, so as to reinforce the secured attachment between the solder and the soldering portion.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, having at least one containing groove penetrated through the insulating body, a bump stopper extended from a sidewall of the containing groove, and a solder stop portion extended laterally downward from the bump stopper;

at least one conductive terminal, installed in the containing groove, and each conductive terminal having a main body portion disposed between the solder stop portion and the sidewall, a contact portion formed by extending and bending both ends of the main body portion upwardly and separately, and the two contact portions being disposed between both sides of the bump stopper and the solder stop portion, at least one soldering portion extended downwardly from the main body portion and plated with a solderable metal layer, and the soldering portion having a base layer, at least one diffusion preventing area concavely formed on the base layer and disposed above the solderable metal layer, and the diffusion preventing area being higher than the lowest point of the solder stop portion; and at least one solder, placed at the containing groove, and abutted against the solder stop portion, and a side of the solder being in contact with the solderable metal layer.

2. The electrical connector of claim 1, wherein the bump stopper is disposed above the main body portion.

3. The electrical connector of claim 2, wherein the bump stopper and the main body portion are abutted with each other.

4. The electrical connector of claim 1, wherein the two contact portions have free ends connected with each other to form an abutting portion at a position where the free ends are connected.

5. The electrical connector of claim 4, wherein the solder stop portion is in contact with a lateral surface of the abutting portion.

6. The electrical connector of claim 4, wherein the bump stopper is disposed above the abutting portion.

7. The electrical connector of claim 6, wherein the bump stopper and the abutting portion are abutted with each other.

8. The electrical connector of claim 1, wherein a portion of the solderable metal layer is plated at the main body portion above the diffusion preventing area.

9. The electrical connector of claim 1, wherein the soldering portion has a multi-layer structured cross-section, and the base layer includes an inner layer and a non-solderable metal layer plated on the inner layer, and the solderable metal layer is plated onto the non-solderable metal layer, and the diffusion preventing area is partially and concavely entered into the non-solderable metal layer.

10. The electrical connector of claim 1, wherein the main body portion and the solder stop portion are contacted with each other.

11. The electrical connector of claim 1, further comprising an interval formed between the main body portion and the solder stop portion.

12. The electrical connector of claim 1, wherein the diffusion preventing area is an area for separating and defining the soldering portion and the main body portion.

13. The electrical connector of claim 1, wherein the two contact portions include two bottom portions respectively, and a narrow groove is formed between the two bottom portions, and the narrow groove includes a clamping slot and a guiding space, and the guiding space has a width greater than the clamping slot.

14. The electrical connector of claim 1, wherein the containing groove has a gap formed at a position proximate to a side of the soldering portion.

15. The electrical connector of claim 1, wherein the solder stop portion is formed and bent from an end of the bump stopper.

16. The electrical connector of claim 1, wherein the at least one soldering portion includes a plurality of soldering portions, each soldering portion is formed and extended downwardly and separately from both ends of the main body portion, an accommodating space is formed between the soldering portions, and the solder is partially entered into the accommodating space.

17. An electrical connector, comprising:

an insulating body, having at least one containing groove penetrated through the insulating body, and a solder stop portion extended from a sidewall of the containing groove;

at least one conductive terminal, installed in the containing groove, and each conductive terminal having a main body portion disposed between the solder stop portion and the sidewall, and a contact portion formed by extending and bending both ends of the main body portion upwardly and separately, and the two contact portions being disposed on both sides of the solder stop portion respectively, and at least one soldering portion extended downwardly from the main body portion and plated with a solderable metal layer, and the soldering portion having a base layer, and at least one diffusion preventing area concavely formed on the base layer and disposed above the solderable metal layer, and the diffusion preventing area being higher than the lowest point of the solder stop portion; and at least one solder, placed at the containing groove, and abutted against the solder stop portion, and a side of the solder being in contact with the solderable metal layer.

18. The electrical connector of claim 17, wherein the solder stop portion is passed through the bump stopper and coupled to the sidewall.

19. The electrical connector of claim 18, wherein the two contact portions have free ends connected with each other, and an abutting portion is formed at a position where the free ends are connected.

20. The electrical connector of claim 19, wherein the solder stop portion is in contact with lateral side of the abutting portion.

21. The electrical connector of claim 19, wherein the bump stopper is disposed above the abutting portion.

22. The electrical connector of claim 21, wherein the bump stopper and the abutting portion are abutted with each other.

23. The electrical connector of claim 17, wherein the two contact portions have free ends connected with each other, an abutting portion is formed at a position where the free ends are connected, and the solder stop portion is disposed above the abutting portion.

24. The electrical connector of claim 17, wherein the solderable metal layer is partially plated at a position of the main body portion above the diffusion preventing area.

25. The electrical connector of claim 17, wherein the containing groove includes a gap formed at a position proximate to a side of the soldering portion.

* * * * *